US006004164A

United States Patent [19]

Seko et al.

[11] Patent Number: 6,004,164

[45] Date of Patent: Dec. 21, 1999

[54] CONNECTOR PROVIDED WITH A RETAINER

[75] Inventors: Satomi Seko; Masamitsu Chishima, both of Yokkaichi, Japan

[73] Assignee: Sumitomo Wiring Systems, Ltd., Japan

[21] Appl. No.: 09/154,257

[22] Filed: Sep. 16, 1998

[51] Int. Cl.[6] ..... H01R 13/434

[52] U.S. Cl. ..... 439/752

[58] Field of Search ..... 439/752, 595

[56] References Cited

U.S. PATENT DOCUMENTS

| | | | |
|---|---|---|---|
| 5,437,565 | 8/1995 | Atsumi et al. | 439/752 |
| 5,653,613 | 8/1997 | Shimoda | 439/752 |

FOREIGN PATENT DOCUMENTS

| | | |
|---|---|---|
| 0 700 125 | 3/1996 | European Pat. Off. . |
| 41 24 505 | 1/1993 | Germany . |
| 5-23455 | 3/1993 | Japan . |
| 8-250215 | 9/1996 | Japan . |

*Primary Examiner*—Gary Paumen

*Attorney, Agent, or Firm*—Anthony J. Casella; Gerald E. Hespos

[57] ABSTRACT

A connector is provided with a retainer in which a retainer insertion hole is covered and terminal fittings are retained with a large force. The connector has an inner housing 12 fittable into an outer housing 11. A retainer insertion hole 23 is so provided as to extend in a direction normal to the extension of cavities 15. A retainer 40 inserted into this insertion 23 faces rear end surfaces 31B of main portions 31 of terminal fittings 30 to prevent the terminal fittings 30 from coming out. According to this embodiment, since the retainer 40 directly prevents the terminal fittings 30 from coming out, the terminal fittings 30 can be retained with a large force. Further, the retainer insertion hole 23 in the inner housing is covered by the outer housing 11 and therefore is not exposed.

7 Claims, 7 Drawing Sheets

CONNECTOR PROVIDED WITH A RETAINER

BACKGROUND OF THE INVENTION

1. Field of the Invention

The present invention relates to an electrical connector provided with a retainer.

2. Description of the Prior Art

Generally, there are two types of electrical connectors provided with a retainer, namely, a side retainer type (see Japanese Unexamined Utility Model Publication No. 6-5870) and a front retainer type (see Japanese Unexamined Utility Model Publication No. 5-23455 and Japanese Unexamined Patent Publication No. 8-250215).

A typical prior art side retainer type of connector is shown in FIG. 7, and has a retainer 3 mounted in a direction normal to the insertion direction of terminal fittings 2 into a connector housing 1. Accordingly, a retainer insertion hole 4 is open in one side surface of the connector housing 1. This type of prior art connector has an advantage of retaining the terminal fittings 2 with a larger force since the retainer 3 directly locks the terminal fittings 2, as shown in FIG. 8.

A prior art front retainer type of connector is shown in FIG. 9, and has a retainer 5 inserted into a connector housing 6 along the insertion direction of terminal fittings 2. Accordingly, a retainer insertion hole 7 is open in an engaging surface with a mating connector. This type of prior art connector has an advantage that the retainer insertion hole 7 is covered by the mating connector, and therefore is not exposed.

The prior art does not include a connector provided with a retainer which has advantages of both types.

In view of the above, it is an object of the present invention to provide a connector provided with a retainer in which a retainer insertion hole is covered and terminal fittings are retained with a large force.

SUMMARY OF THE INVENTION

According to the invention, there is provided a connector with a retainer. The connector includes a housing formed with at least one cavity into which a terminal fitting is insertable substantially along an engaging direction. The connector housing is comprised of inner and outer housings which are lockingly engaged or engageable with each other, and the terminal fitting is insertable substantially along the engaging direction of the inner housing with the outer housing. A retainer insertion hole extends in a direction at an angle different from 0° or 180°, preferably substantially normal to the extension of the cavity, and a retainer is insertable into the retainer insertion hole. The terminal fitting inserted into the cavity is securely retained so as not to come out of the cavity when the retainer is positioned in its locking position in the retainer insertion hole.

According to a preferred embodiment, the inner housing is formed with the at least one cavity, and preferably, the inner housing is provided with the retainer insertion portion.

According to a further preferred embodiment, there is provided a connector with a retainer. The connector comprises a connector housing comprised of inner and outer housings which are lockingly engaged with each other. The inner housing is formed with at least one cavity into which a terminal fitting is insertable along an engaging direction of the inner housing with the outer housing and a retainer insertion hole extending in a direction normal to the extension of the cavity. A retainer is insertable into the retainer insertion hole in such a position that the terminal fitting inserted into the cavity is securely retained and will not come out of the cavity.

Preferably, the retainer is located substantially at the back of the retainer insertion hole and projects into the cavity to face the terminal fitting inserted thereinto in such a direction as to prevent the terminal fitting from coming out of the cavity. Since the retainer directly prevents the terminal fitting from coming out, the terminal fitting can be retained with a large force. Further, since the retainer insertion hole is formed in the inner housing, it covered by the outer housing, and is not exposed to the outside.

Preferably, the retainer projects outwardly from the inner housing when the retainer is in a non-locking position in the retainer insertion hole that would not securely retain the terminal fitting in the cavity. Accordingly, the outwardly projecting portions of an incompletely inserted retainer interfere with the outer housing, with the result that the inner and outer housings cannot be assembled. This prevents the connector from being assembled while the terminal fitting is not locked by the retainer.

Further preferably, there are further provided a first waterproof ring which is provided between the outer housing and a mating connector housing into which the outer housing is insertable. The first waterproof ring can be brought into sealable contact with both the outer housing and the mating connector housing. A second waterproof ring is provided between the outer surface of the inner housing in a position more distanced from the mating connector housing than the retainer insertion hole and the inner surface of the outer housing. The second waterproof ring can be brought into sealable contact with both the outer and inner housings or surfaces.

Accordingly, the clearance that provides communication between the cavity and the outside is sealed by the first and second waterproof rings, thereby eliminating a likelihood that the terminal fitting is exposed to water.

According to still a further preferred embodiment, the terminal fittings and/or the housing, preferably the inner housing, are provided with first locking means for locking the terminal fittings in the cavity before the terminal fittings are retained by the retainer. Accordingly, the connector is provided with a double-lock function, which facilitates the mounting and overall handling.

Preferably, the retainer comprises one or more insertion spaces into which the terminal fittings are insertable when the retainer is located in a non-locking position, and one or more locking spaces substantially communicating with the corresponding insertion spaces. The terminal fittings are displaced into the one or more locking spaces when the retainer is moved into its locking position.

Further preferably, a portion of the retainer adjacent to the locking spaces interact with a portion of the terminal fittings, preferably an end surface of a main portion thereof.

Most preferably, the retainer and/or the housing, preferably the inner housing, comprise retainer locking means for locking the retainer in the housing, when the retainer is arranged in the locking position.

These and other objects, features and advantages of the present invention will become more apparent upon a reading of the following detailed description and accompanying drawings.

DETAILED DESCRIPTION OF THE PREFERRED EMBODIMENTS

Figure 1:
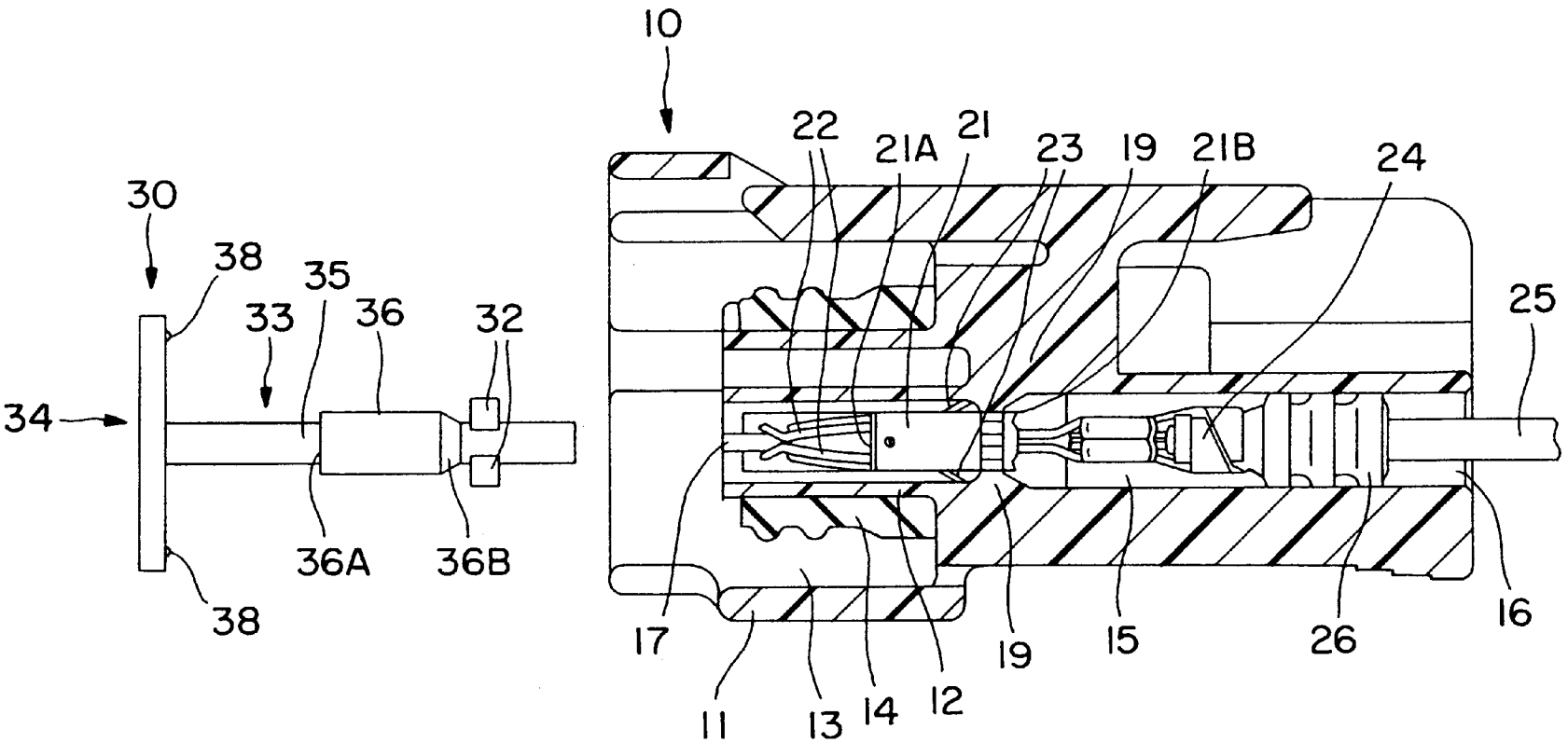
FIG. 1 is a side view in section of an outer housing of one embodiment of the invention.
Figure 2:
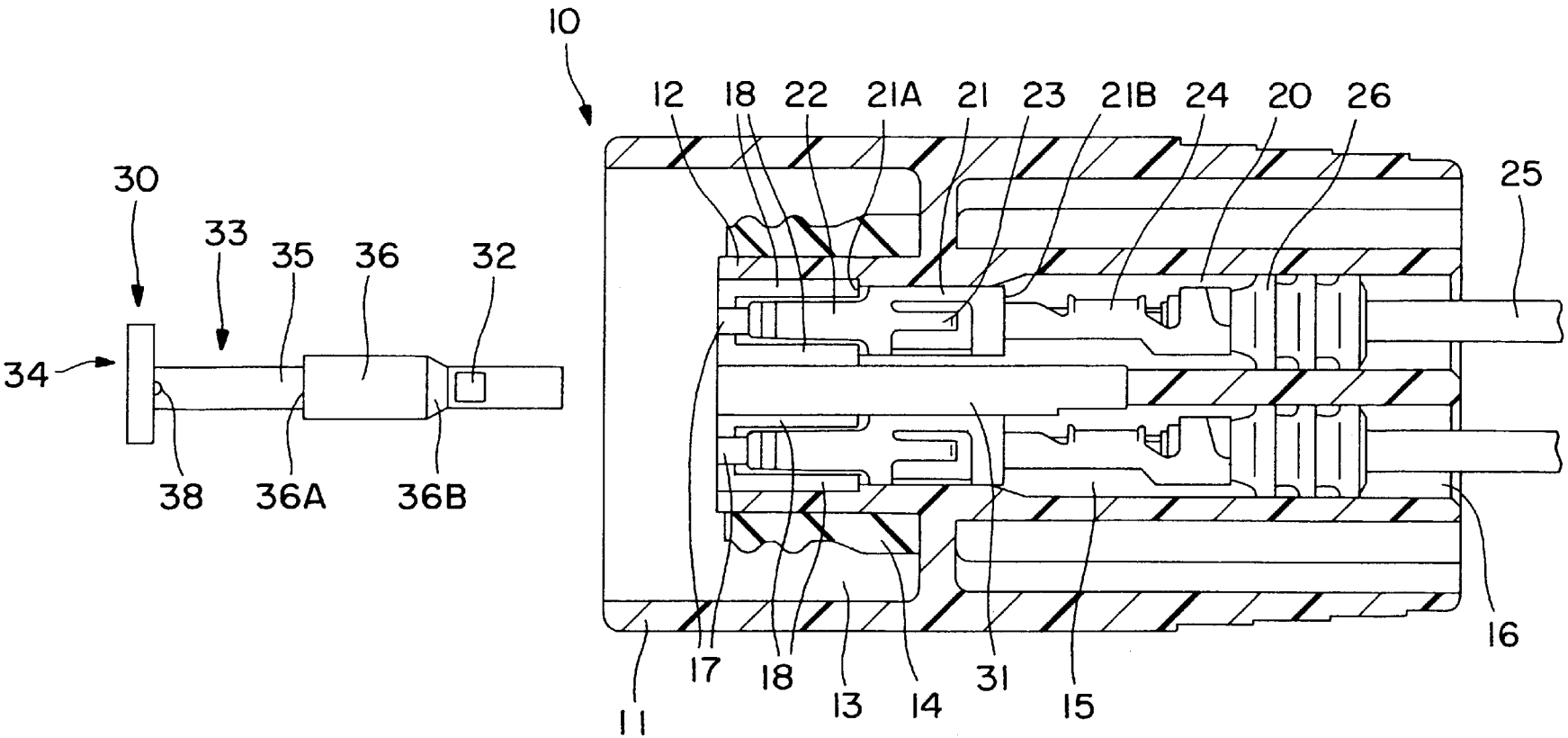
FIG. 2 is a side view in section of an inner housing of the embodiment.

A connector housing of a connector according to this embodiment is comprised of outer housing 11 as shown in FIG. 1 and inner housing 12, as shown in FIG. 2. The housings 11, 12 are substantially engageable with each other, as explained herein.

A front surface of the outer housing 11 is shown at the left of FIG. 1, and is configured to be engaged with a mating connector (not shown). A receptacle 13 is defined at the front surface of the outer housing 11, and a main body 14 is provided inside the receptacle 13. A space 14A is defined between the receptacle 13 and the main body 14 to accommodate a mating receptacle for the connection of the two connectors. A first waterproof ring 16 is fitted on the outer surface of the main body 14, and will be in sealing contact with the inner surface of the mating receptacle and the outer surface of the main body 14 by being compressed between these surfaces. An accommodation hole 17 extends through the main body substantially in an engaging direction ED with the mating connector for accommodating the inner housing 12. The inner housing 12 is insertable into the accommodation hole 17 through its rear opening. A substantially front (left in FIG. 1) opening of the accommodation hole 17 forms a tab insertion opening 18. Male tabs (not shown) of the mating connector are insertable through the tab insertion opening 18. Further, a substantially rear part of the accommodation hole 17 is preferably entirely or circumferentially widened, thereby forming a stepped portion 19. Lock holes 19A are formed in the upper and lower surfaces at a rear part of the stepped portion 19.

Figure 4:
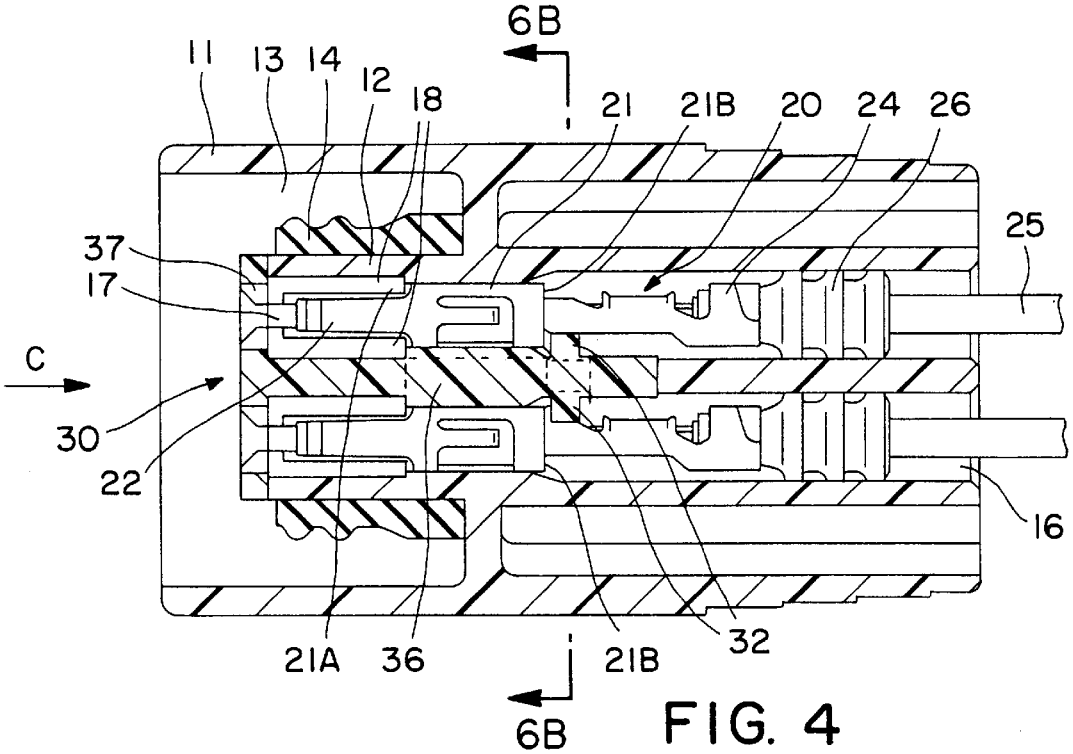
FIG. 4 is an exploded perspective view of the embodiment.
Figure 6A:
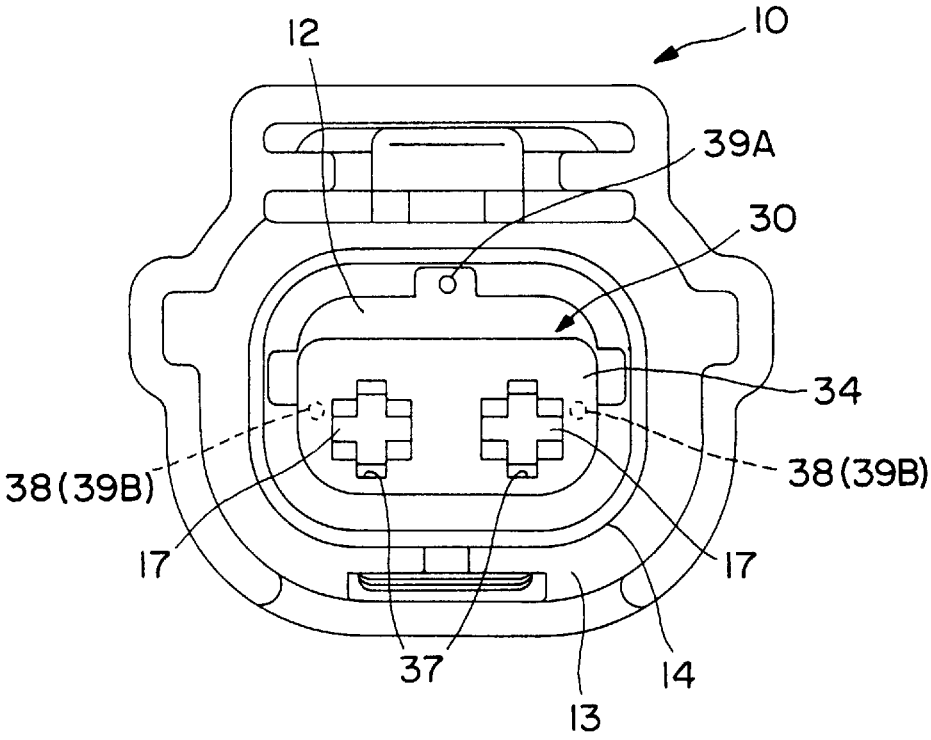
FIG. 6 is a section of A—A of FIG. 2 showing a position of the retainer fully locked.
Figure 6B:
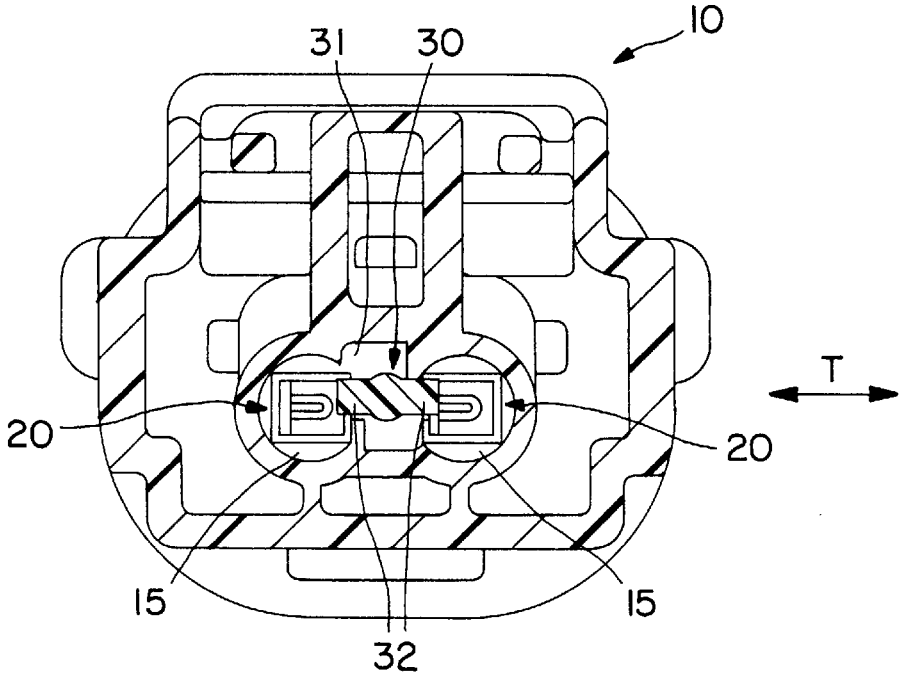
Figure 7:
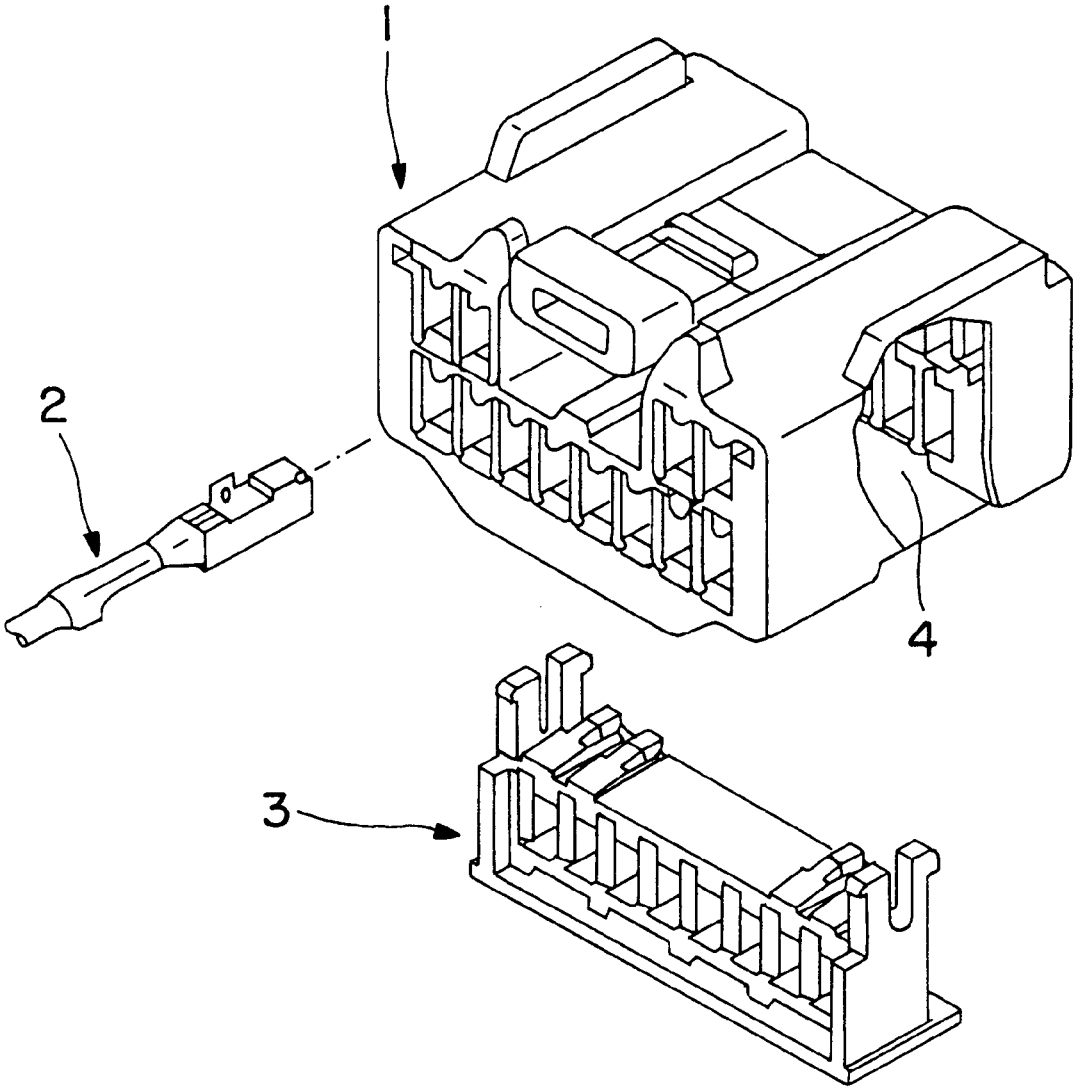
FIG. 7 PRIOR ART
FIG. 7 is a perspective view of a prior art side retainer type connector.
Figure 8:
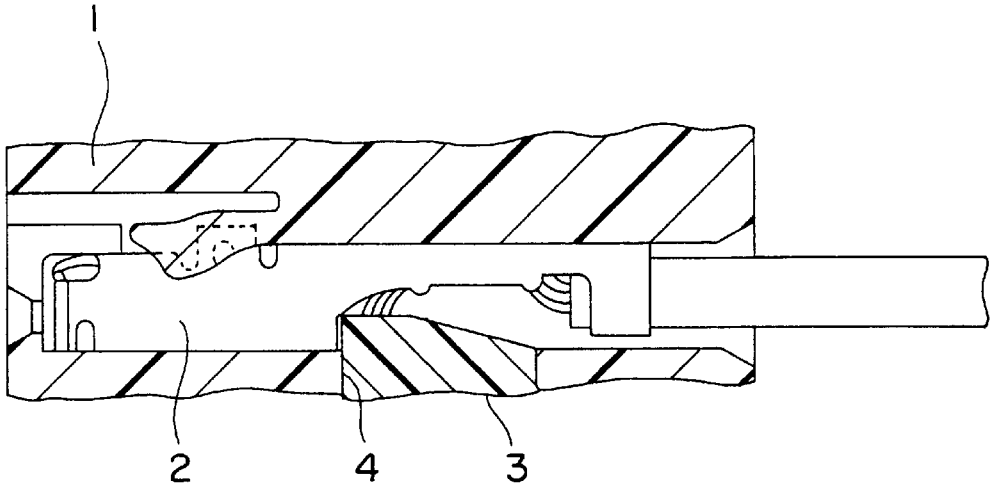
FIG. 8 PRIOR ART
FIG. 8 is a partial side view of this prior art connector.
Figure 9:
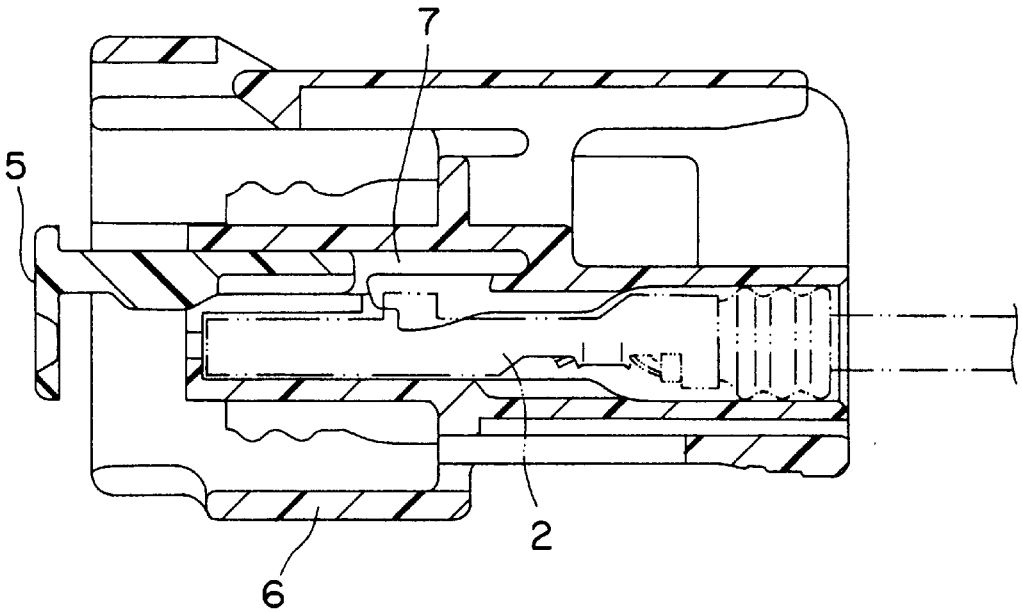
FIG. 9 PRIOR ART
FIG. 9 is a side view in section of a prior art front retainer type connector.
Figure 1:
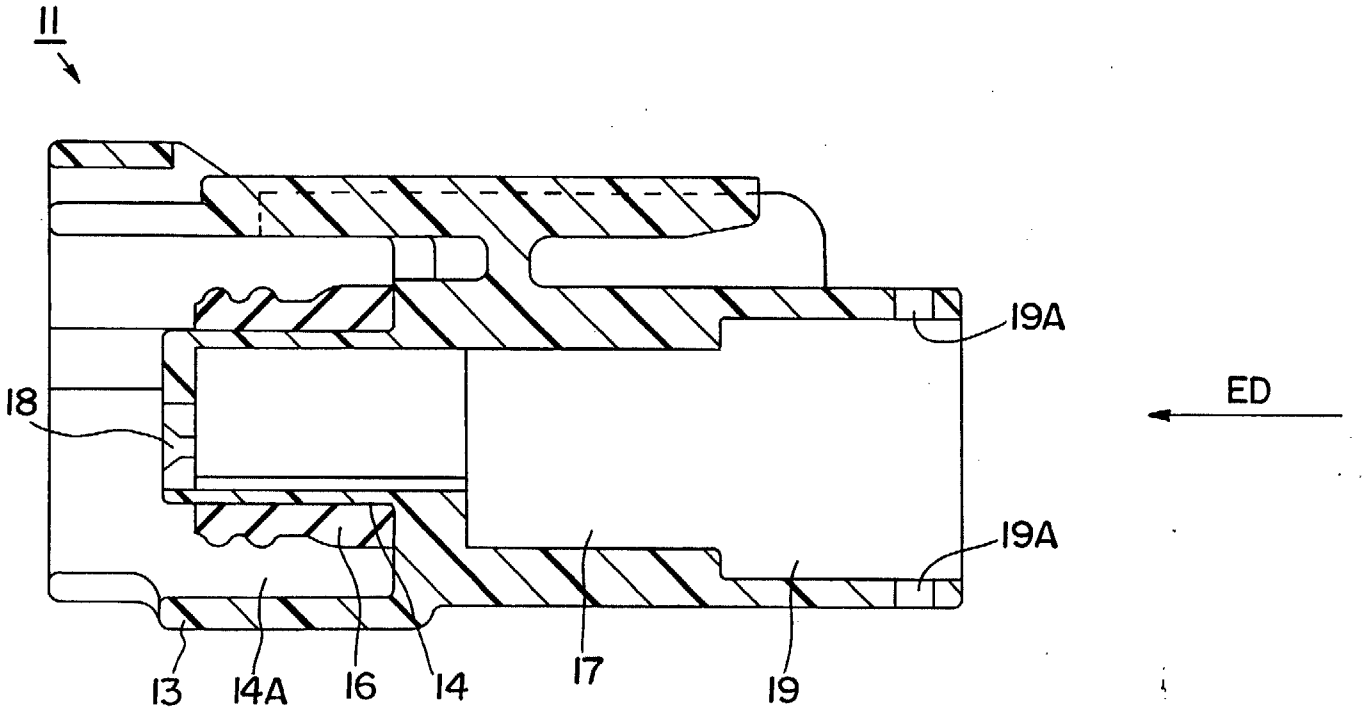
Figure 2:
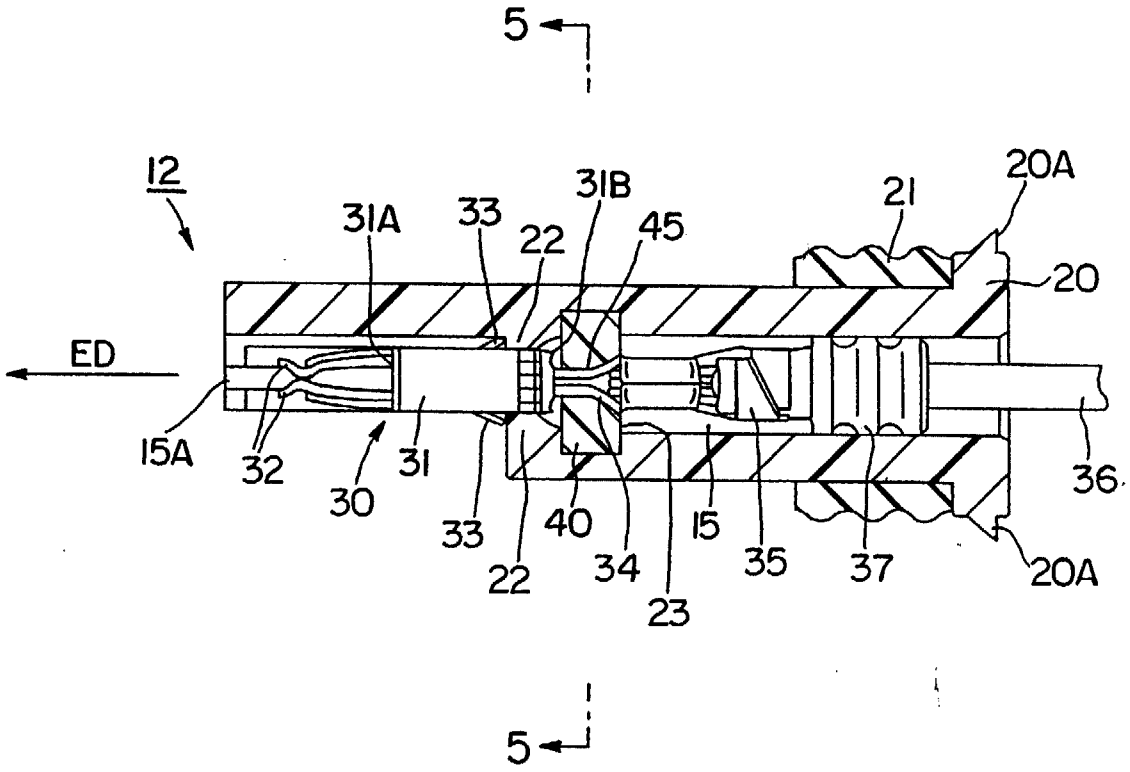
Figure 4:
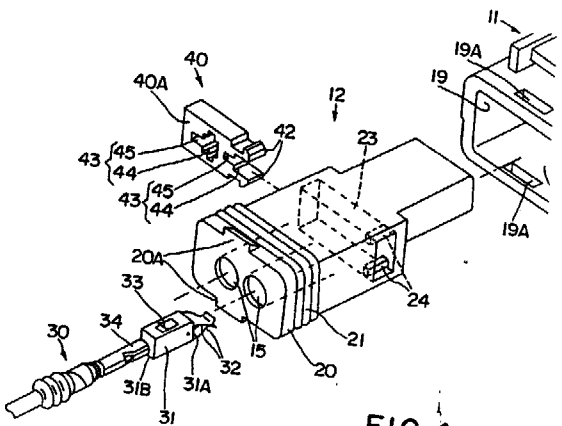
Figure 3:
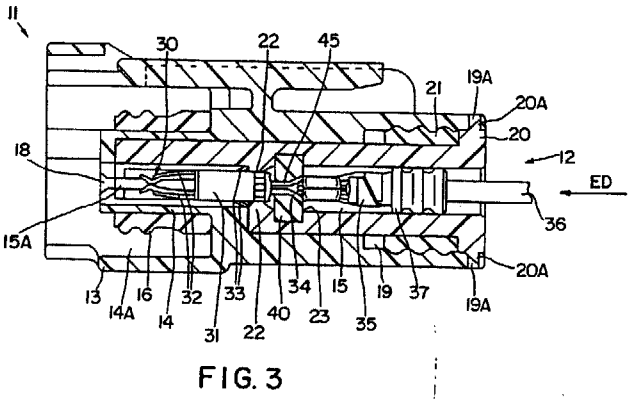

On the other hand, the inner housing 12 which is entirely shown in FIG. 4 has such length and cross section that it can be at least partially fitted into the accommodation hole 17. A flange 20 is provided at a rear end portion of the inner housing 12, and bulges sideways preferably over its entire outer surface so as to correspond to the stepped portion 19 of the outer housing 11. Lock projections 20A are formed on the upper and lower surfaces of the flange 20 and are engageable with the lock holes 19A. Further, a second waterproof ring 21 is mounted on a rear part of the outer surface of the inner housing 12 in such a manner as to substantially abut against the flange 20. The second waterproof ring 21 is brought into sealing contact with the inner surface of the stepped portion 19 of the outer housing 11 and the outer surface of the inner housing 12 by being compressed and deformed therebetween.

A pair of cavities 15 are so formed in the inner housing 12 as to extent in the substantially engaging direction ED with the outer housing 11, and terminal fittings 30 are inserted or insertable thereinto. As shown in FIG. 2, a front side of each cavity 15 is open in the lower surface of the inner housing 12, and this open portion is closed by the inner wall of the accommodation hole 17 (see FIG. 3). The open portions of the cavities 15 (15A in FIGS. 2 and 3) are aligned with the tab insertion openings 18 of the outer housing 11, and the male tabs are inserted into the cavities 15 through the tab insertion openings 18.

Figure 3:
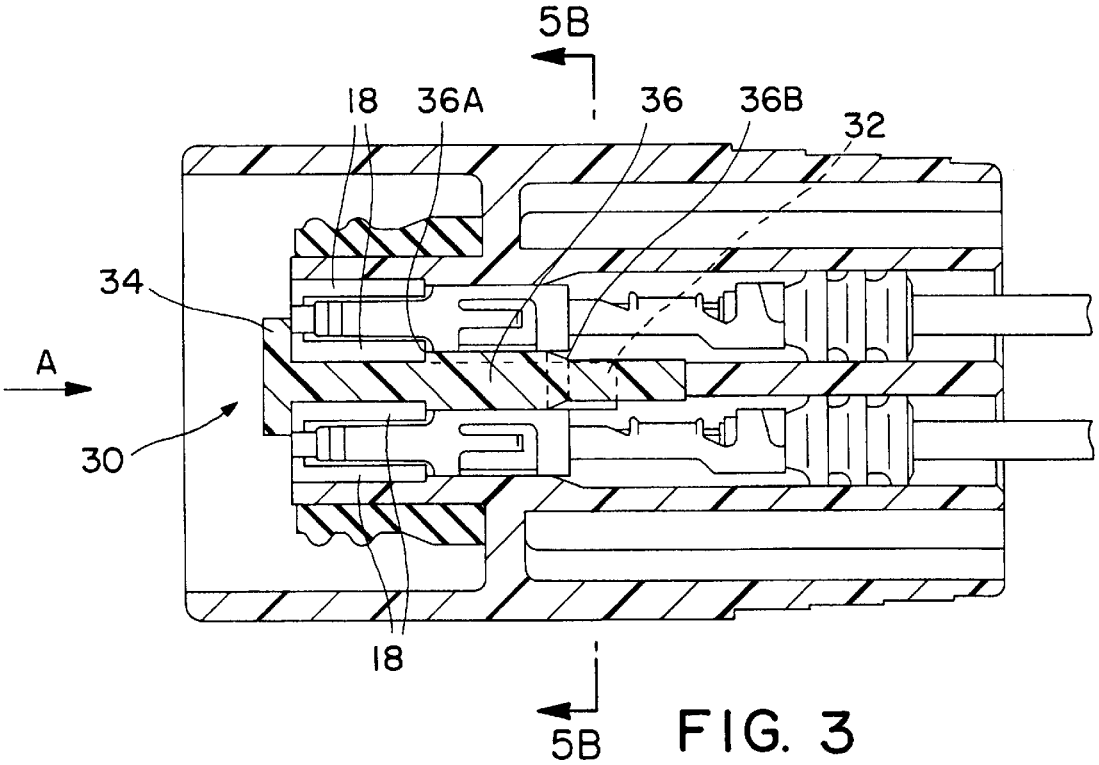
FIG. 3 is a side view in section of the inner and outer housings in their assembled state.

The terminal fitting 30 is formed as shown in FIGS. 2 and 3 e.g. by cutting a conductive metal plate and bending the cut piece. A front end surface 31A of a main portion 31 substantially in the form of a rectangular parallelepiped is brought into contact with a contact wall (not shown) formed in the cavity 15, thereby substantially positioning the terminal fitting 30 in the cavity 15 with respect to the forward direction (leftward direction in FIG. 2). A pair of opposite pieces 32 extend substantially forwardly from the front end surface 31A of the main portion 31 in such a manner as to be closer to each other or that a distance therebetween tapers or decreases, and the male tab is held or holdable between these opposite pieces 32 to establish an electrical connection therewith. Further, a pair of metal lances or locking portions 33 extend obliquely backwardly from opposite side walls of the main body 31. These metal locking portions 33 are locked with receiving projections 22 formed in the cavity 15 so as to prevent the terminal fitting 30 from coming out of the cavity 15 (see FIGS. 2 and 3).

Figure 5A:
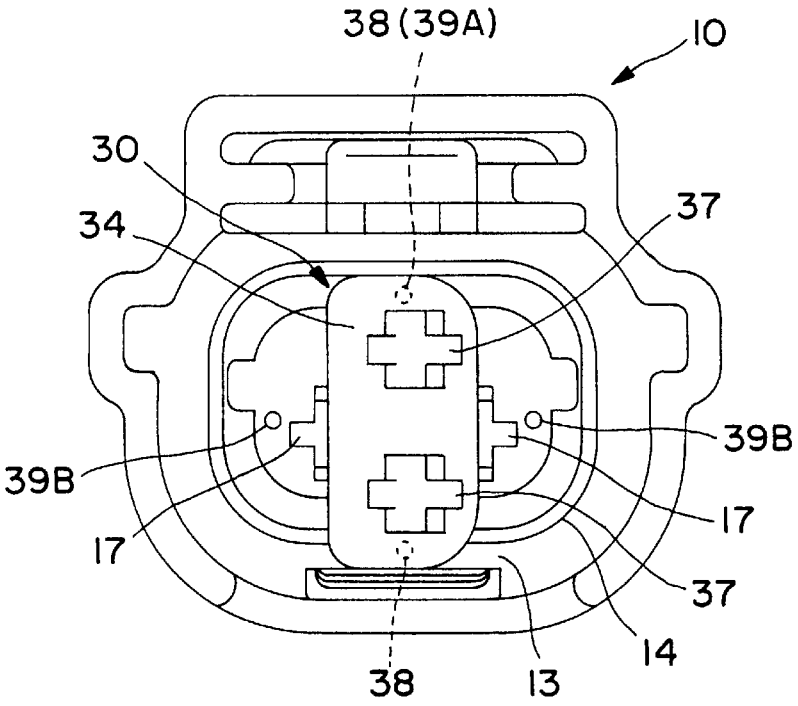
FIG. 5 is a section along A—A of FIG. 2 showing a position of a retainer partly locked.
Figure 5B:
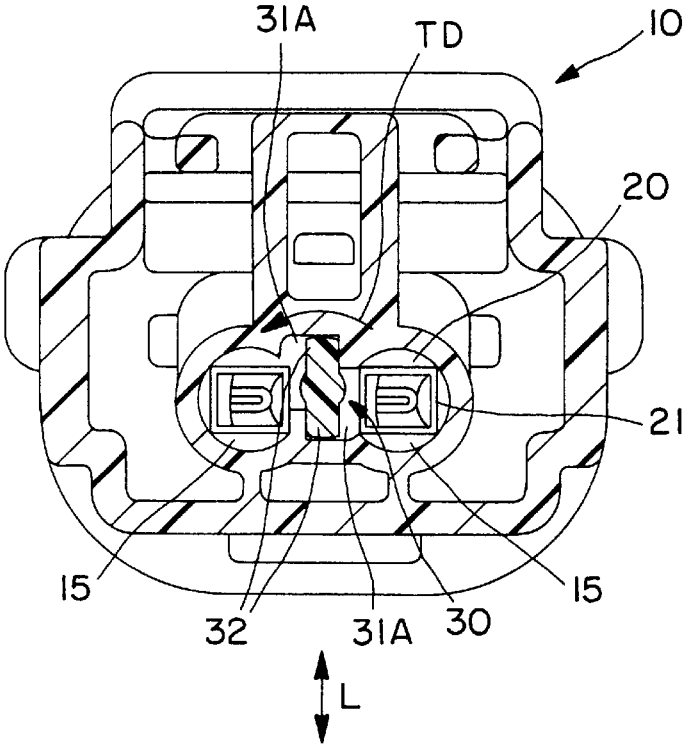
Figure 5:
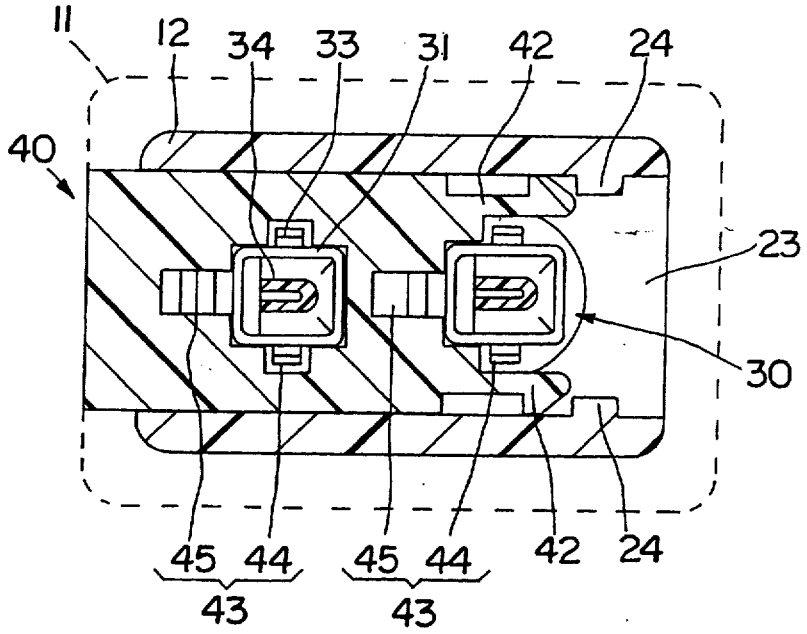

A connecting portion 34 extends substantially backwardly from a substantially center portion at a rear end surface 31B of the main portion 31. A barrel portion 35 for the connection with a wire 36 is provided at the leading end of the connecting portion 34. The connecting portion 34 has a cross section smaller than the main portion 31 as shown in FIG. 5 so as to be fittable into a locking space 45 provided in a retainer 40 to be described later. Further, a waterproof rubber plug 37 is mounted or mountable on the barrel portion 35 as well as on an end of the wire 36 as shown in FIGS. 2 and 3. This waterproof rubber plug 37 is or can be brought in sealing contact with the outer sheath of the wire 36 and the inner surface of the cavity 15.

As shown in FIG. 4, a retainer insertion hole 23 is formed in the inner housing 12, and preferably extends over the substantially entire width of the inner housing 12 in a direction at an angle different from 0° or 180°, and preferably substantially normal to the extension of the cavities 15. Intersecting portions of the cavities 15 and the retainer insertion hole 23 correspond to the connecting portions 34 of the terminal fittings 30 properly accommodated in the cavities 15 as shown in FIG. 2. As shown in FIG. 5, a pair of projections 24 are formed on the upper and lower surfaces of the retainer insertion hole 23 near a right opening of FIG. 5, and lock portions 42 provided on the retainer 40 as described later are lockingly engaged or engageable with these projections 24.

Figure 6:
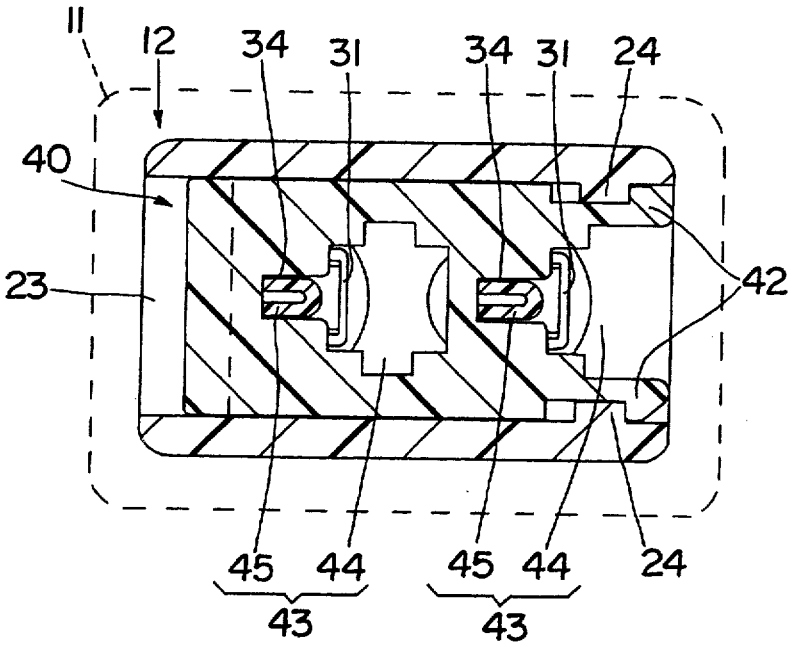
Figure 7:
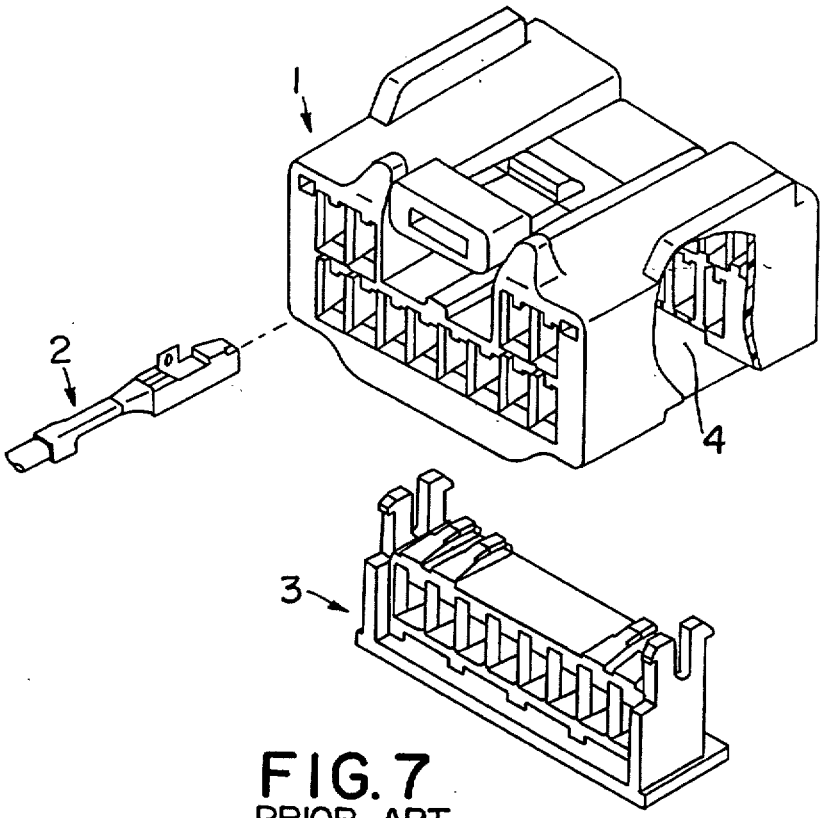
FIG. 7 PRIOR ART
Figure 8:
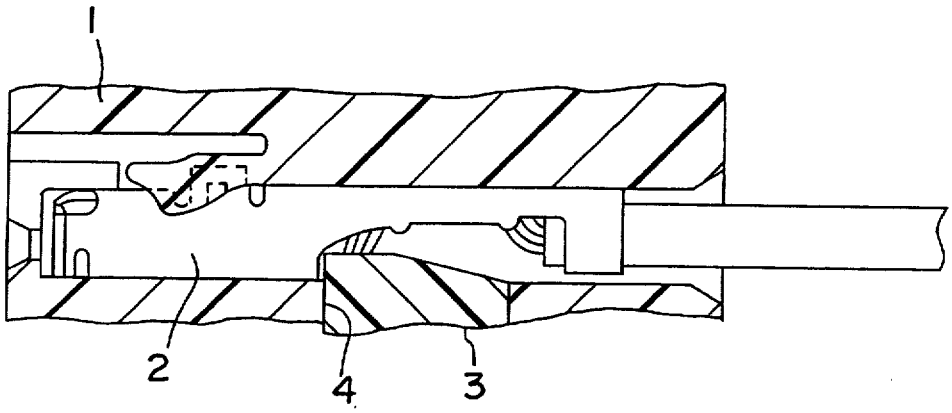
FIG. 8 PRIOR ART
Figure 9:
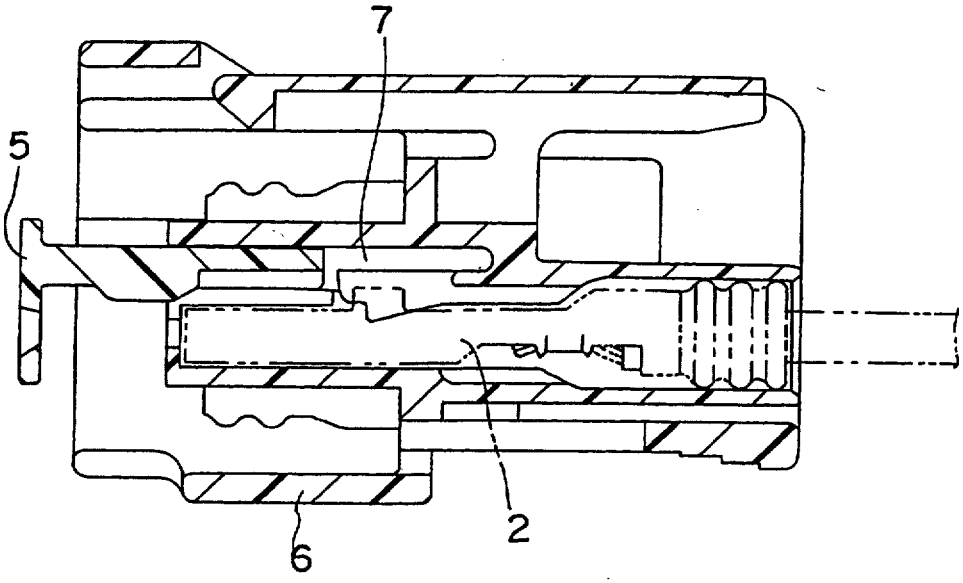
FIG. 9 PRIOR ART

The retainer 40 has a substantially platelike shape, and is dimensioned and configured to be fittable into the retainer insertion hole 23 as shown in FIG. 4. The aforementioned pair of lock portions 42 extend forwardly from the front surface of the retainer 40 with respect to its insertion direction. A pair of terminal retaining portion 43 are provided between the locking portions 42 and/or in a plate portion 40A. Each terminal retaining portion 43 is comprised of an insertion space 44 into which the main portion 31 of the terminal fitting 30 is insertable substantially in a direction of the thickness of the retainer 40 and the locking space 45 which communicates with the insertion space 44 and into which only the connecting portion 34 of the terminal fitting 30 is insertable. As shown in FIG. 5, when the leading end of the lock portions 42 of the retainer 40 inserted into the insertion hole 23 from the left side of FIG. 5 abuts against the projection 24, the insertion spaces 44 substantially face or communicate with the cavities 15. When the retainer 40 is further pushed to engage the locking portions 42 with the projections 24 as shown in FIG. 6, the locking spaces 45 substantially face the cavities 15. As shown in FIG. 5, the retainer 40 projects from the inner housing 12 when the locking portions 42 abut against the projections 24. However the retainer 40 is accommodated substantially entirely in the retainer insertion hole 23 when the locking portions 42 are engaged with the projections 24, as shown in FIG. 6.

To assemble the connector of this embodiment, the retainer 40 is first inserted into the retainer insertion hole 23 of the inner housing 12 until the locking portions 42 of the retainer 40 are struck against the projections 24 (see FIG. 5). Then, the insertion spaces 44 of the retainer 40 substantially face the cavities 15. The terminal fittings 30 can be inserted into the cavities 15 without interference from the retainer 40, since the main portions 31 of the terminal fittings 30 are insertable into the insertion spaces 44. When the terminal fittings 30 are inserted to the back of the cavities 15, the metal locking portions 33 thereof move over the receiving projections 22, thereby being locked therewith (see FIG. 2). This is referred to as "partial locking". At this time, the terminal fittings 30 are positioned with respect to the forward direction by the main portions 31 thereof abutting against the contact walls (not shown) of the cavities 15.

In this state, the retainer 40 preferably is pushed strongly into the retainer insertion hole 23. Then, as shown in FIG. 6, the connecting portions 34 of the terminal fittings 30 enter the locking spaces 45 of the retainer 40, and the plate portion 40A of the retainer 40 substantially faces the rear end surfaces 31B of the main portions 31 of the terminal fittings 30 (see FIG. 2), with the result that the terminal fittings 30 are directly retained by the retainer 40 so as not to come out of the cavities 15, thereby being brought into their double-locked states. At this time, the locking portions 42 of the retainer 40 move over the projections 24 in the retainer insertion hole 23, thereby being locked therewith (see FIG. 6). Here, if the terminal fittings 30 are insufficiently inserted, the main portions 31 thereof are located in the insertion spaces 44 of the retainer 40 and terminal fittings 30 interfere with the retainer 40. Thus, the retainer 40 cannot be pushed to the back and, as a result, the insufficient insertion of the terminal fittings 30 can be detected.

Finally, the inner housing 12 is inserted to the back of the accommodation hole 17 of the outer housing 11. Then, the inner housing 12 is retained in the accommodation hole 17 so as not to come therefrom by the engagement of the lock projections 20A of the inner housing 12 and the lock holes 19A of the outer housing 12, and a clearance between the outer and inner housings 11 and 12 is sealed by the second waterproof ring 21. Here, unless the retainer 40 is in such a position as to retain the terminal fittings 30, it projects from the side surface of the inner housing 12, thereby interfering with the outer housing 11. Accordingly, the inner housing 12 cannot be fitted entirely into the outer housing 11. This prevents the connector of this embodiment from being assembled without the terminal fittings being locked by the retainer 40 (double lock state).

When this connector is connected with a mating connector, the male terminals of the mating connector are inserted into the cavities 15 to be electrically connected with the terminal fittings 30. Further, a clearance between the two connectors is sealed by the first waterproof ring 16.

As described above, according to the connector of this embodiment, the terminal fittings 30 can be retained with a strong force since the retainer 40 directly retains the terminal fittings 30 so as not come out. Further, since the retainer insertion hole 23 is provided in the inner housing 12, it is not exposed outside by being covered by the outer housing 11. In other words, the present invention provides a connector having the advantages of the prior art side retainer type connector and front retainer type connector. Further, since the clearances between the cavities 15 and the outside are sealed by the first and second waterproof rings 16, 21 and the waterproof plug 37. Consequently, the terminal fittings 30 are not to be exposed to water.

The present invention is not limited to the described and illustrated embodiment, but the following embodiments are also embraced by the technical scope of the present invention as defined in the claims. First, although the present invention is applied to the watertight connector in the foregoing embodiment, it may be applied to nonwatertight connectors. Second, although two terminal fittings 30 are accommodated in the connector of the foregoing embodiment, the number of the terminal fittings may be 1 or 3 or more. In such a case, the retainer may be provided with terminal locking portions corresponding to the number of the terminal fitting(s). Besides these embodiments, a variety of other changes can be made without departing from the scope and spirit of the invention as defined in the claims.

What is claimed is:

1. A connector provided with a retainer, comprising;

an inner housing formed with at least one cavity into which a terminal fitting is insertable substantially along an engaging direction and a retainer insertion hole extending substantially normal to the inserting direction, a retainer insertable into the retainer insertion hole, the retainer being configured such that the terminal fitting inserted into the cavity is securely retained so as not to come out of the cavity when the retainer is positioned in a locking position in the retainer insertion hole, and an outer housing lockingly engaged over the inner housing and substantially covering the retainer insertion hole and the retainer, such that locking engagement of the outer housing over the inner housing ensures that the retainer is in the locking position and not exposed to exterior portions of the connector.

2. A connector according to claim 1, wherein the retainer projects outward from the inner housing when in a non-locking position in the retainer insertion hole that does not securely retain the terminal fitting.

3. A connector according to claim 1, further comprising:

a first waterproof ring provided between the outer housing and a mating connector housing into which the outer housing is insertable, the first waterproof ring being configured for sealable contact with both the outer housing and the mating connector housing, and a second waterproof ring which is provided between the outer surface of the inner housing in a position more distanced from the mating connector housing than the retainer insertion hole and the inner surface of the outer housing, the second waterproof ring being configured for sealable contact with both the outer and inner housings.

4. A connector according to claim 1, wherein the terminal fittings and the inner housing are provided with first locking means for locking the terminal fittings in the cavity before the terminal fittings are retained by the retainer.

5. A connector according to claim 1, wherein the retainer comprises at least one insertion space into which the terminal fittings are insertable when the retainer is located in a non-locking position, and at least one locking space substantially communicating with the corresponding insertion space, the terminal fittings being displaced into the locking space when the retainer is moved into its locking position.

6. A connector according to claim 5, wherein a portion of the retainer adjacent to the locking spaces interacts with an end surface of a main portion of the terminal fittings.

7. A connector according to claim 6, wherein the retainer and the inner housing comprise retainer locking means for locking the retainer in the housing, when the retainer is arranged in the locking position.

* * * * *

UNITED STATES PATENT AND TRADEMARK OFFICE

CERTIFICATE OF CORRECTION

PATENT NO. : 6,004,164
DATED : December 21, 1999
INVENTOR(S) : Satomi Seko, et al.

It is certified that error appears in the above-identified patent and that said Letters Patent is hereby corrected as shown below:

The sheets of drawings consisting of figures 1-9 should be deleted to appear as per attached figures 1-9.
The title page, should be deleted to appear as per attached title page.

Signed and Sealed this

Nineteenth Day of September, 2000

*Attest:*

Q. TODD DICKINSON

*Attesting Officer*

*Director of Patents and Trademarks*

US006004164A

United States Patent [19]

Seko et al.

[11] Patent Number: 6,004,164

[45] Date of Patent: Dec. 21, 1999

[54] CONNECTOR PROVIDED WITH A RETAINER

[75] Inventors: Satomi Seko; Masamitsu Chishima, both of Yokkaichi, Japan

[73] Assignee: Sumitomo Wiring Systems, Ltd., Japan

[21] Appl. No.: 09/154,257

[22] Filed: Sep. 16, 1998

[51] Int. Cl.[6] ..... H01R 13/434

[52] U.S. Cl. ..... 439/752

[58] Field of Search ..... 439/752, 595

[56] References Cited

U.S. PATENT DOCUMENTS 5,437,565 8/1995 Atsumi et al. ..... 439/752
5,653,613 8/1997 Shimoda ..... 439/752

FOREIGN PATENT DOCUMENTS 0 700 125 3/1996 European Pat. Off. .
41 24 505 1/1993 Germany .
5-23455 3/1993 Japan .
8-250215 9/1996 Japan .

*Primary Examiner*—Gary Paumen
*Attorney, Agent, or Firm*—Anthony J. Casella; Gerald E. Hespos

[57] ABSTRACT

A connector is provided with a retainer in which a retainer insertion hole is covered and terminal fittings are retained with a large force. The connector has an inner housing 12 fittable into an outer housing 11. A retainer insertion hole 23 is so provided as to extend in a direction normal to the extension of cavities 15. A retainer 40 inserted into this insertion 23 faces rear end surfaces 31B of main portions 31 of terminal fittings 30 to prevent the terminal fittings 30 from coming out. According to this embodiment, since the retainer 40 directly prevents the terminal fittings 30 from coming out, the terminal fittings 30 can be retained with a large force. Further, the retainer insertion hole 23 in the inner housing is covered by the outer housing 11 and therefore is not exposed.

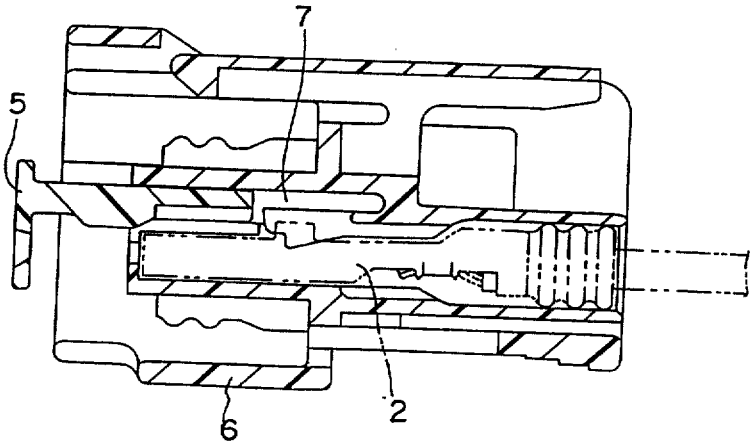

7 Claims, 7 Drawing Sheets